US007263321B2

(12) United States Patent
Inui et al.

(10) Patent No.: US 7,263,321 B2
(45) Date of Patent: Aug. 28, 2007

(54) IMAGE FORMING APPARATUS WITH SPEED DETECTOR FOR DETECTING ROTATIONAL SPEED OF A TENSION ROLLER

(75) Inventors: Hiroshi Inui, Osaka (JP); Akira Matayoshi, Osaka (JP); Mitsuhiro Hashimoto, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 11/343,004

(22) Filed: Jan. 30, 2006

(65) Prior Publication Data

US 2006/0171748 A1 Aug. 3, 2006

(30) Foreign Application Priority Data

Jan. 31, 2005 (JP) ..... 2005-022940
Nov. 21, 2005 (JP) ..... 2005-335609

(51) Int. Cl.
*G03G 15/01* (2006.01)

(52) U.S. Cl. ..... 399/299; 399/301; 399/302; 399/308

(58) Field of Classification Search ..... 399/301, 399/298, 299, 302
See application file for complete search history.

(56) References Cited

U.S. PATENT DOCUMENTS 5,612,771 A * 3/1997 Yamamoto et al. ..... 399/301
5,881,346 A * 3/1999 Mori et al. ..... 399/301
5,991,561 A * 11/1999 Okamoto et al. ..... 399/66
6,157,799 A * 12/2000 Asakura et al. ..... 399/167
6,330,404 B1 * 12/2001 Munenaka et al. ..... 399/51
2003/0099483 A1 * 5/2003 Sakurai et al. ..... 399/111
2004/0184831 A1 * 9/2004 Isobe ..... 399/66

FOREIGN PATENT DOCUMENTS

JP 2003-233233 8/2003
JP 2003233233 A * 8/2003

* cited by examiner

*Primary Examiner*—David M. Gray
*Assistant Examiner*—Geoffrey T Evans
(74) *Attorney, Agent, or Firm*—Gerald E. Hespos; Anthony J. Casella

(57) ABSTRACT

Disclosed is an image forming apparatus, which comprises an intermediate transfer belt (15), and a plurality of image-forming units (11) to (14) disposed along the intermediate transfer belt (15) and adapted to form toner images of different colors and sequentially transfer the toner images onto the intermediate transfer belt (15) in a superimposed manner so as to form a color toner image. The intermediate transfer belt (15) is laid across a drive roller (16), a driven roller (17) and a tension roller (18), in a tensioned condition. A rotation speed of the tension roller (18) adapted to apply a tension to the intermediate transfer belt (15) is detected to obtain a linear speed of the intermediate transfer belt (15). In a process of color-misregistration correction, a write-start timing for each toner image of the colors is adjusted based on the linear speed of the intermediate transfer belt (15).

6 Claims, 13 Drawing Sheets

FIG.9A LIGHT-RECEIVING SIGNAL AT GIVEN POSITION

FIG.9B LIGHT-RECEIVING SIGNAL AT UPWARDLY-MOVED POSITION OF ACTUATOR

FIG.9C LIGHT-RECEIVING SIGNAL AT DOWNWARDLY-MOVED POSITION OF ACTUATOR

IMAGE FORMING APPARATUS WITH SPEED DETECTOR FOR DETECTING ROTATIONAL SPEED OF A TENSION ROLLER

BACKGROUND OF THE INVENTION

1. Field of the Invention

The present invention relates to an image forming apparatus using an electrophotographic process, such as a copy machine, a printer or a facsimile machine, and more particularly to a color image forming apparatus having an intermediate transfer belt.

2. Description of the Related Art

Generally, in an image forming apparatus designed to arrange respective image-forming units for four colors consisting of magenta (M), cyan (C), yellow (Y) and black (BK) along an intermediate transfer belt, so-called "tandem-type color image forming apparatus", toner images of respective colors are sequentially transferred from the image-forming units to the intermediate transfer belt to form a color toner image on the intermediate transfer belt, and then color toner image is transferred to a recording sheet (hereinafter referred to simply as "sheet"). In order to correct color misregistration, this type of color image forming apparatus is designed to measure an amount of misregistration between patches of respective colors using a registration sensor and change an image write-start timing depending on the measured misregistration amount.

While the misregistration amount can be measured with a high degree of accuracy only if a linear speed of the intermediate transfer belt is accurately known, a linear speed of the intermediate transfer belt is varied depending on slip between the intermediate transfer belt and a drive belt, change in an outer diameter of a drive roller due to environmental variations and other factors. Thus, there is the need for measuring a linear speed of the intermediate transfer belt during the correction of color misregistration.

Heretofore, as measures for reducing color misregistration in an image, there has been a technique of forming markings on an intermediate transfer belt at given intervals and detecting the markings to obtain a speed of the intermediate transfer belt based on the detection result.

Further, Japanese Patent Laid-Open Publication No. 2003-233233 discloses a color image forming apparatus designed to detect a speed of a driven roller driven by an intermediate transfer belt, calculate a speed of the intermediate transfer belt based on the detected velocity of the driven roller, calculate a difference value between the calculated speed and a target speed of the intermediate transfer belt, and correct the speed of the intermediate transfer belt based on the calculated difference value. This Japanese Patent Laid-Open Publication No. 2003-233233 also discloses a technique of, during printing in one of a plurality of low-speed modes (1/2, 1/3, 1/4 speed mode), performing a speed correction in a (1/1) speed mode, i.e., high speed mode, before forming an actual image on an intermediate transfer belt, and determining a speed of the intermediate transfer belt for each of the low-speed modes after completion of the speed correction so as to omit a speed correction for the intermediate transfer belt during subsequent printing.

In a color image forming apparatus designed to perform a print operation at high, speed, even a slight speed variation in an intermediate transfer belt causes occurrence of color misregistration. If it is attempted to detect a linear speed of the intermediate transfer belt using markings as in the conventional technique, the markings have to be formed on the intermediate transfer belt using stickers or the like at several-micron-order intervals. It is technically difficult to form such markings.

If it is attempted to obtain a linear speed of an intermediate transfer belt based on a rotation speed of a driven roller as in the Japanese Patent Laid-Open Publication No. 2003-233233, a difference between the rotation speed of the driven roller and the linear speed of the intermediate transfer belt is likely to occur due to slip between the intermediate transfer belt and the driven roller to cause difficulty in accurately obtaining the linear speed of the intermediate transfer belt based on the rotation speed of the driven roller. This leads to a problem about difficulty in correcting color misregistration with a high degree of accuracy.

SUMMARY OF THE INVENTION

In view of the above problems in the conventional techniques, it is an object of the present invention to provide an image forming apparatus capable of accurately measuring a linear speed of an intermediate transfer belt to allow color misregistration to be corrected with a high degree of accuracy.

In order to achieve the above object, the present invention provides an image forming apparatus which comprises: a transfer belt adapted to allow a plurality of toner images of different colors to be sequentially superimposed and transferred onto a surface thereof or a recording sheet placed on the surface so as to form a color toner image; a plurality of image-forming units disposed along the transfer belt and each adapted to form a toner image with a corresponding one of the colors and transfer the toner image onto the transfer belt or recording sheet; a drive roller for rotationally driving the transfer belt; a tension roller allowing the transfer belt to be laid thereacross in a tensioned condition in cooperation with the drive roller, wherein the tension roller is adapted to apply a tension to the transfer belt; and a speed detector for detecting a rotation speed of the tension roller and outputting a roller rotation speed signal.

In the image forming apparatus of the present invention, when the transfer belt is designed to allow a plurality of toner images of different colors to be sequentially superimposed and transferred onto a surface thereof, the image forming apparatus may include a transfer device for transferring the color toner image on the transfer belt to a recording sheet at a secondary transfer position. In this case, the tension roller may be disposed between the secondary transfer position and one of the image-forming units which is located on a downstreammost side of the transfer belt in a rotation direction thereof.

According to the present invention, the tension roller can apply a tension to the transfer belt to eliminate a problem about occurrence of slip between the tension roller and the transfer belt. Thus, a linear speed of the transfer belt can be accurately detected by measuring a rotation speed of the tension roller using the speed detector. Further, the detected rotation speed of the tension roller can be used for performing color-misregistration correction with a high degree of accuracy. This makes it possible to provide an image forming apparatus capable of stably forming a clear sophisticated color image without color misregistration.

The tension roller may be disposed between the secondary transfer position for the transfer device and the image-forming unit located on a downstreammost side of the transfer belt in a rotation direction thereof (or on a rotationally downstreammost side of the transfer belt).

In this case, a linear speed of the transfer belt just after the color superimposition process can be measured by detecting a rotation speed of the tension roller. That is, when an image defect, such as color misregistration, occurs in a formed image, a linear speed of the transfer belt just after occurrence of the color misregistration can be detected. This makes it possible to acquire on-target linear speed information required for accurate color-misregistration correction. If a linear speed of the transfer belt (a rotation speed of the tension roller) is measured on a rotationally downstream side of the transfer belt relative to the secondary transfer position, the linear speed of the measured transfer belt is likely to be different from a linear speed at a position where a color toner image is actually formed on the transfer belt, due to influences of driving by the drive roller disposed at the secondary transfer position and/or a secondary transfer, to cause difficulty in acquiring on-target linear speed information.

DETAILED DESCRIPTION OF THE PREFERRED EMBODIMENTS

Figure 1:
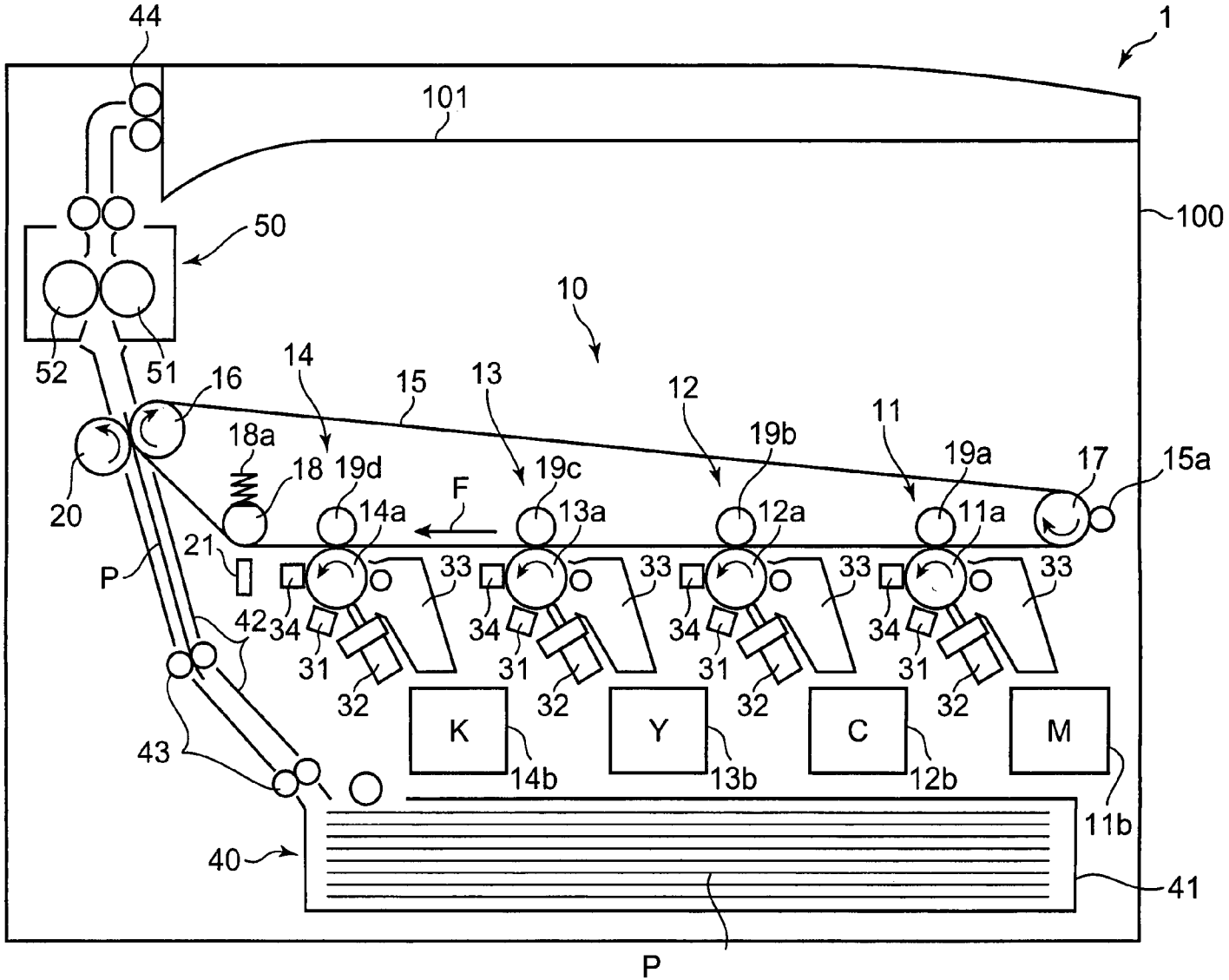
FIG. 1 is a schematic sectional view showing a tandem-type color printer according to one embodiment of the present invention.

With reference to the drawings, an image forming apparatus of the present invention will now be described by taking a printer as one example of the image forming apparatus. FIG. 1 is a schematic sectional view showing a tandem-type color printer 1 according to one embodiment of the present invention. As shown in FIG. 1, this printer 1 comprises an image forming section 10, sheet feeding section 40 and a fixing section 50, which are housed in a housing 100; For facilitating understanding, only the image forming section 10 is extracted and schematically shown in FIG. 2 in the form of a sectional view.

The image forming section 10 includes four image-forming units 11 to 14 designed, respectively, for four different colors consisting of magenta (M), cyan (C), yellow (Y) and block (K). These image-forming units 11 to 14 operate to form (print) a color image or monochrome image onto a sheet. Each of the image-forming units 11 to 14 includes a photosensitive drum (11*a* to 14*a*) adapted to be rotated in a direction indicated by the arrow in FIG. 1 and made, for example, of amorphous silicon, and a toner supply device (11*b* to 14*b*) (toner cartridge) for a corresponding one of the colors consisting of magenta (M), cyan (C), yellow (Y) and block (K). Each of the image-forming units 11 to 14 further includes an electrostatically charging device 31, a light-exposing device 32, a development device 33 and a cleaning device 34, which are disposed around the photosensitive drum (11*a* to 14*a*) in this order from an upstream side in the rotation direction thereof.

The components of the magenta (M) image-forming unit 11 will be described below. The electrostatically charging device 31 is provided as a means to uniformly charge a surface of the photosensitive drum 11*a* at a given potential. The light-exposing device 32 is a so-called laser scanning unit, and provided as a means to irradiate the surface of the photosensitive drum 11*a* with a laser beam (LED light) generated based on image data transmitted from an after-mentioned image data storage section 62 (see FIG. 11), etc., so as to form an electrostatic latent image on the photosensitive drum 11*a*. The development device 33 is provided as a means to attach toner supplied from the toner supply device 11*b* associated with the development device 33, onto the electrostatic latent image formed on the photosensitive drum 11*a*, so as to allow the electrostatic latent image to be visualized as a toner image (magenta toner image). The cleaning device 34 is provided as a means to clean toner residing on the surface of the photosensitive drum 11*a* after completion of a primary transfer process of transferring toner images onto an after-mentioned intermediate transfer belt 15. The remaining image-forming units 12 to 14 are constructed in the same manner to form a cyan toner image, a yellow toner image, a black toner image, respectively.

Figure 2:
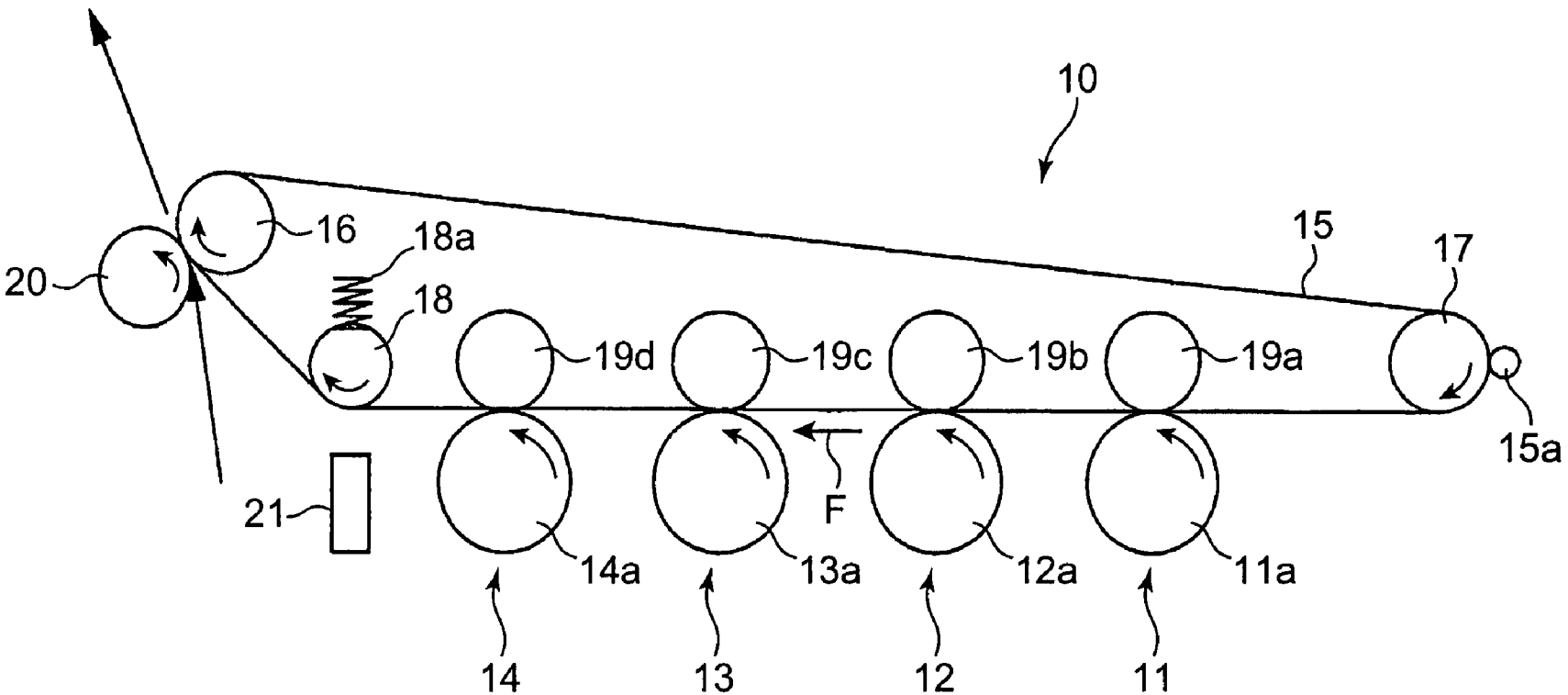
FIG. 2 is a fragmentary schematic sectional view showing an image forming section in the printer illustrated in FIG. 1.

On the upper side of the image-forming units 11 to 14, the image forming section 10 further includes an intermediate transfer belt 15 and four primary transfer rollers 19*a* to 19*d* (intermediate transfer rollers) for subjecting the visualized toner images on the photosensitive drums 11*a* to 14*a* to an intermediate transfer (primary transfer) process. As shown in FIGS. 1 and 2, the intermediate transfer rollers 19*a* to 19*d* are aligned along the intermediate transfer belt 15.

The intermediate transfer belt 15 is composed of a given belt member laid across a drive roller 16, a driven roller 17 and a tension roller 18 in a tensioned condition, and designed to be rotated or circulated along a drive roller 16, a driven roller 17 and a tension roller 18 in an endless manner while being pressed against the photosensitive drums 11*a* to 14*a* by the primary transfer rollers 19*a* to 19*d* each disposed in opposed relation to a corresponding one of the photosensitive drums 11*a* to 14*a*.

The drive roller 16 is designed to be rotationally driven by a driving source, such as a stepping motor, so as to provide a driving force for rotating the intermediate transfer belt 15 in an endless manner. The driven roller 17 is provided in a manner which allows free rotation, and designed to be rotated in conjunction with the endless rotation of the intermediate transfer belt 15 based on the drive roller 16.

That is, the driven roller 17 is a roller which is to be followingly rotated in response to a main rotation of the drive roller 16 through the intermediate transfer belt 15 while holding (rotationally supporting) the intermediate transfer belt 15.

The tension roller 18 is provided in a manner which allows free rotation as with the driven roller 17. The tension roller 18 is a roller which is to be followingly rotated in response to a main rotation of the drive roller 16 through the intermediate transfer belt 15 while holding (rotationally supporting) the intermediate transfer belt 15, and is operable to apply a tension (tensile force) to the intermediate transfer belt 15 so as to prevent the intermediate transfer belt 15 from coming loose. For example, this tension roller 18 is designed to generate the above tension in such a manner as to receive a biasing force from a biasing member 18*a*, such as a spring, and thereby apply a pressing force to the intermediate transfer belt 15 in a direction from an inner peripheral surface (back surface) to an outer peripheral surface (front surface) of the intermediate transfer belt 15. The tension roller 18 is disposed between a secondary transfer position for an after-mentioned secondary transfer roller 20 and the image-forming units 14 located on a rotationally downstreammost of the intermediate transfer belt 15.

The intermediate transfer belt 15 is rotationally driven in a direction indicated by the arrow F in FIG. 1, according to the rotational driving of the drive roller 16. As mentioned above, the primary transfer rollers 19*a* to 19*d* are disposed in opposed relation, respectively, to the photosensitive drums 11*a* to 14*a* while interposing the intermediate transfer belt 15 therebetween, and respective toner images on the photosensitive drums 11*a* to 14*a* are sequentially superimposed and transferred (primarily transferred) onto the intermediate transfer belt 15 by the primary transfer rollers 19*a* to 19*d* to form a color toner image on the intermediate transfer belt 15. That is, the toner images formed on the photosensitive drums 11*a* to 14*a* are transferred (primarily transferred) onto the intermediate transfer belt 15 which is being endlessly rotated, in such a manner as to be sequentially superimposed in the order of magenta, cyan, yellow and black while matching respective timings or matching respective positions of the toner images (e.g. one edge of the toner image). In this way, a color image consisting of the toner images of the four colors M, C, Y, K is formed on the intermediate transfer belt 15.

A secondary transfer roller 20 (transfer device) is disposed in opposed relation to the drive roller 16 while interposing the intermediate transfer belt 15 therebetween. A sheet P is fed from the sheet feeding section 40 to a nip region formed between the secondary transfer roller 20 and the intermediate transfer belt 15 laid across the drive roller in a tensioned condition, and the color toner image on the intermediate transfer belt 15 is transferred (secondarily transferred) onto the sheet P. A fur brush 15*a* is disposed in opposed relation to the driven roller 17 while interposing the intermediate transfer belt 15 therebetween. The fur brush 15*a* operates to remove toner residing on the intermediate transfer belt 15.

The sheet feeding section 40 of the printer 1 is provided as a means to feed a sheet to the image forming section 10. The sheet feeding section 40 comprises a sheet-feed cassette 41 for storing various sizes of sheets, a feed passage 42 allowing a sheet to be fed therethrough and a feed roller 43 for feeding a sheet in the feed passage 42. The sheets P are taken out of the sheet-feed cassette 41 one-by-one and fed toward the nip region formed between the secondary transfer roller 20 and the intermediate transfer belt 15. Further, the sheet feeding section 40 operates to feed a sheet P having the secondarily transferred color image to the fixing section 50, and then eject the sheet subjected to a fixing process, to a catch tray 101 provided at a top of a body of the printer 1.

The fixing section 50 is disposed at an appropriate position in the feed passage on a downstream side relative to the secondary transfer roller 20. The fixing section 50 serves as a means to fix the color toner image transferred onto the sheet. The fixing section 50 is provided with a heating roller 51 and a pressing roller 52, and designed to melt the toner on the sheet P by heat of the heating roller 51 while applying a pressure from the pressing roller 52 onto the sheet P, so as to fix the color toner image onto the sheet P.

In this embodiment, the above printer 1 further includes a first optical sensor 21 (see FIGS. 1 and 2) disposed at a position opposed to the tension roller 18, and a second optical sensor (see FIG. 3) disposed at a position adjacent to an end of a rotating shaft of the tension roller 18. The first optical sensor 21 is composed of a reflection-type optical scan sensor, an image pickup device or the like. The first optical sensor 21 serves as both a registration sensor for optically reading a registration-detector pattern printed on the intermediate transfer belt 15, and an image density sensor for optically reading an image-density-detector pattern printed on the intermediate transfer belt 15. A detection signal of the first optical sensor 21 is output to an after-mentioned control unit 60 (see FIG. 11), and used in an image density control and a color-misregistration correction control.

Figure 3:
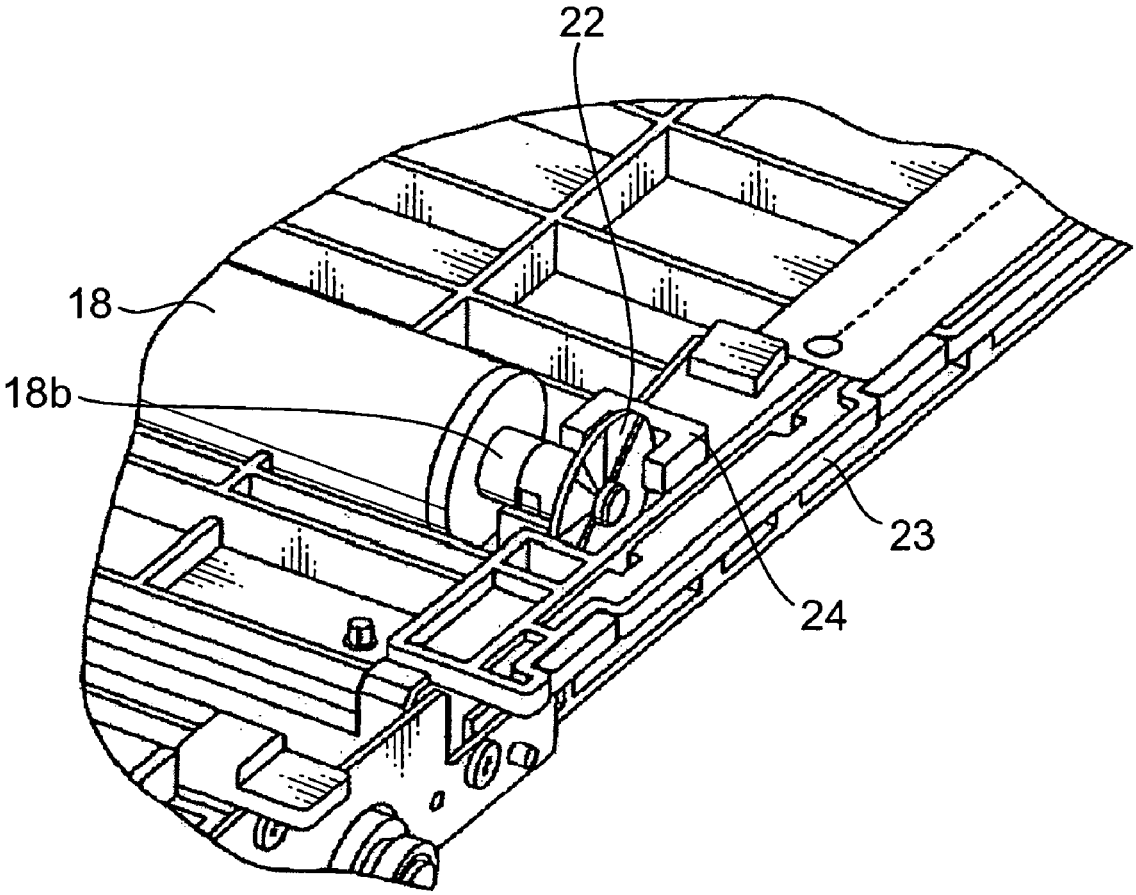
FIG. 3 is a fragmentary schematic perspective view showing a mechanism for detecting a rotation speed of a tension roller in the printer illustrated in FIG. 1.

The second optical sensor 24 serves as speed detector for detecting a rotation speed of the tension roller 18 and outputting a roller rotation speed signal. FIG. 3 is a perspective top view showing one end of the tension roller 18 and its surrounding. In FIG. 3, a speed-detecting actuator 22 (light-blocking member) is connected to the rotating shaft 18*b* of the tension roller 18, in such a manner as to be rotated in synchronization with the rotating shaft 18*b*. This actuator 22 has a circular disc shape. The actuator 22 is formed with a plurality of openings arranged at given angular intervals. For example, each of these openings has a sector shape. The second optical sensor 24 is secured to a printer housing 23 (corresponding to a portion of the housing 100 in FIG. 1) at an appropriate position. The second optical sensor 24 is provided with a light-emitting element and a light-receiving element. The light-emitting element and the light-receiving element are incorporated in the second optical sensor 24 in such a manner that they are disposed in opposed relation to one another while interposing the actuator 22 therebetween.

In the above arrangement, when the actuator 22 is rotated in conjunction with a rotation of the tension roller 18 in a synchronous manner, light to be entered from the light-emitting element into the light-receiving element is intermittently blocked by a plurality of non-opening portions (light-blocking portions) of the actuator 22 which is being rotated. Thus, a rotation speed of the actuator 22 or a rotation speed of the tension roller 18 can be detected based on a time interval in light-blocking of the light to be entered into the light-receiving element. A detection signal (intermittent light-receiving signal) of the second optical sensor 24 is also outputted to the after-mentioned control unit 60.

As described above, a certain tension is applied from the biasing member 18*a* of the tension roller 18 to the intermediate transfer belt 15, and thereby a slip between the intermediate transfer belt 15 and the tension roller 18 is vanishingly unlikely to occur. Thus, the tension roller 18 is rotated in such a manner as to accurately follow a linear speed of the intermediate transfer belt 15, and a rotation speed (linear speed) of the intermediate transfer belt 15 can be accurately obtained by measuring a rotation speed of the tension roller 18.

In this embodiment, the tension roller 18 is disposed between the secondary transfer position for the secondary transfer roller 20 and the image-forming unit 14 located on the rotationally downstreammost side of the intermediate transfer belt 15. Thus, a linear speed of the intermediate transfer belt 15 just after the color superimposition process can be measured by detecting a rotation speed of the tension roller 18. That is, when an image defect, such as color misregistration, occurs in a formed image, a linear speed of the intermediate transfer belt 15 just after occurrence of the color misregistration can be detected. This makes it possible to acquire on-target linear speed information required for accurate color-misregistration correction.

The tension roller 18 is in contact with the intermediate transfer belt 15 while being biased by the biasing member 18*a*. Thus, the tension roller 18 is likely to be slightly moved due to vibration or changed in position due to expansion and contraction of the intermediate transfer belt 15 caused by changes in temperature and humidity or aged deterioration thereof. If the second optical sensor 24 is secured to the printer housing 23, a positional relationship between the actuator 22 and the light-emitting and light-receiving elements of the second optical sensor 24 will be disordered to cause difficulty in detecting a linear speed of the intermediate transfer belt 15 with a high degree of accuracy. From this standpoint, it is desirable to provide a position adjustment mechanism for preventing occurrence of a relative displacement between the actuator 22 and the second optical sensor 24.

Figure 4:
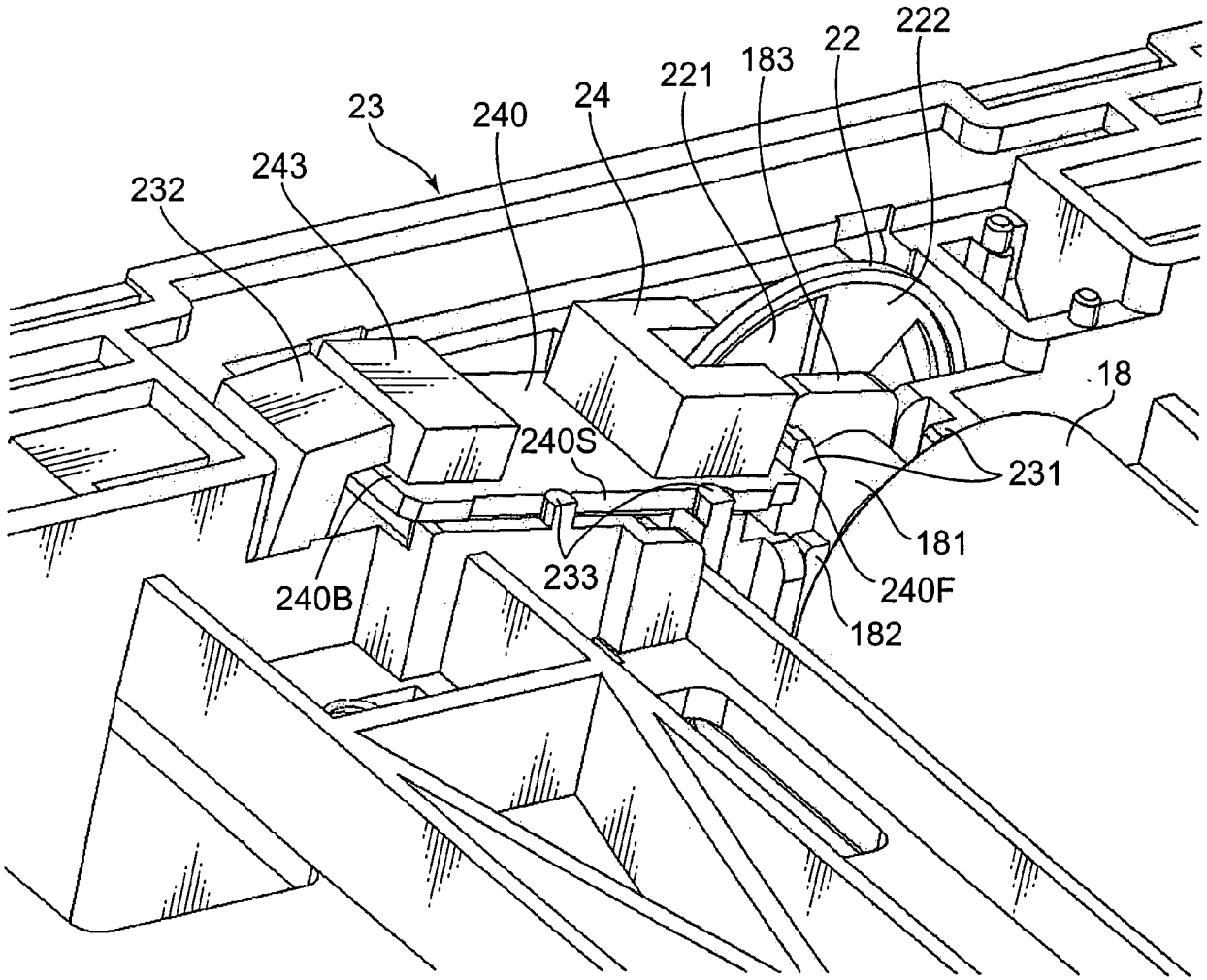
FIG. 4 is a perspective top view showing a bearing section of the tension roller, as an explanatory diagram of a position adjustment mechanism for a speed detector.

One example of the position adjustment mechanism for adjusting a position of the second optical sensor 24 relative to the actuator 22 will be described below with reference to FIGS. 4 to 7. In this example, the speed-detecting actuator 22 attached to the end of the rotating shaft 18*b* of the tension roller 18 is formed to have four sector-shaped openings 221 and four light-blocking portions 222 each located between the adjacent openings 221. Further, a bearing member 181 for rotatably supporting the rotating shaft 18*b* is interposed between the actuator 22 and the end of the tension roller 18. A support member 182 and a bracket 184 are attached to the bearing member 181, and one end of the biasing member 18*a* is in contact with the bearing member 181. That is, a pressing force is applied from the biasing member 18*a* to the bearing member 181, and a reaction force of this pressing force serves as a tension to be applied from the tension roller 18 to the intermediate transfer belt 15. As shown in FIG. 4, the bearing member 181 is fitted between a pair of upright ribs 231 in such a manner as to be movable vertically or in a direction biased by the biasing member 18*a* and restricted in movements in any other direction or lateral wobbling.

Figure 5:
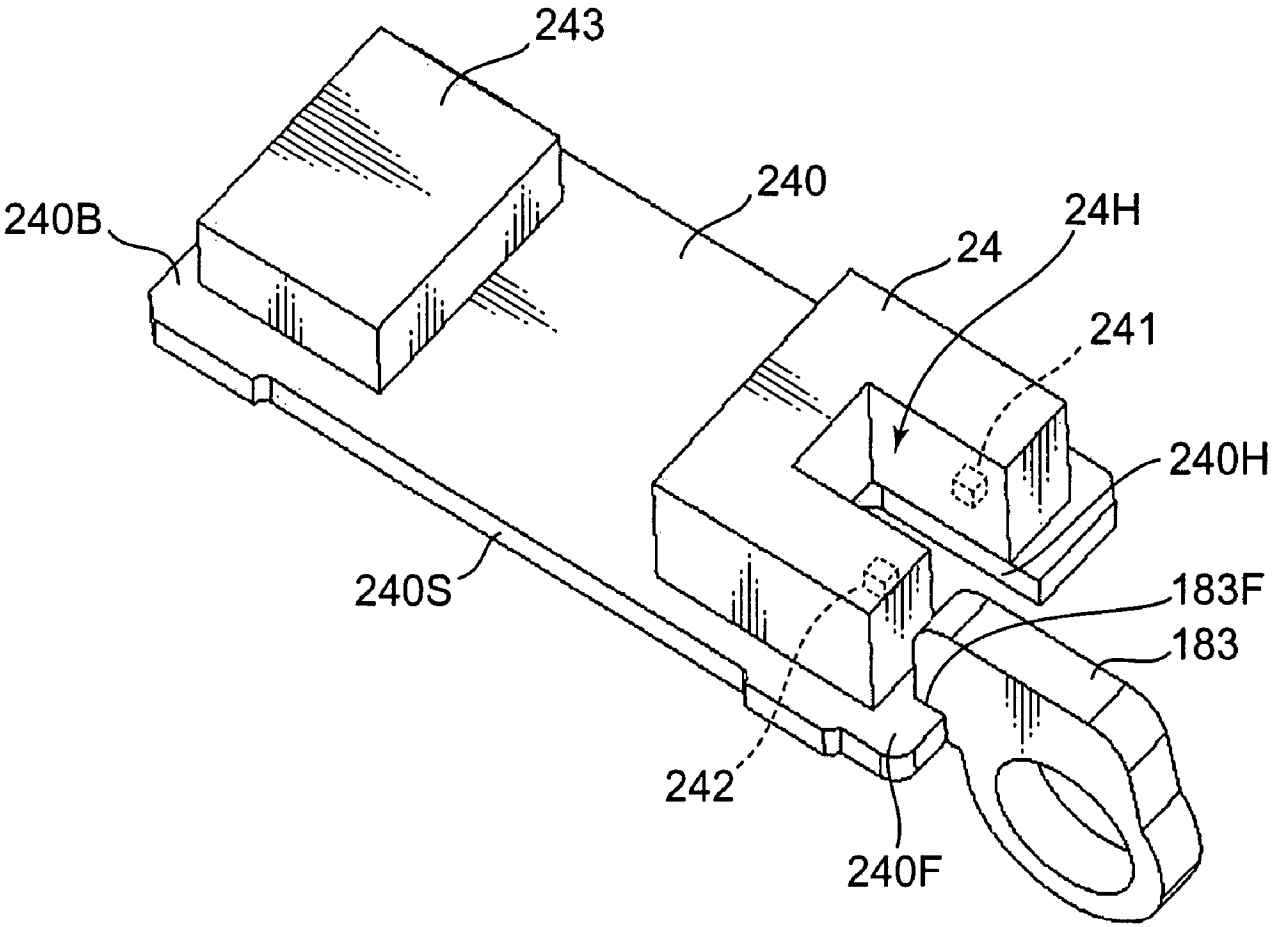
FIG. 5 is a perspective view showing a component (a board mounting a second optical sensor) of the position adjustment mechanism.
Figure 6:
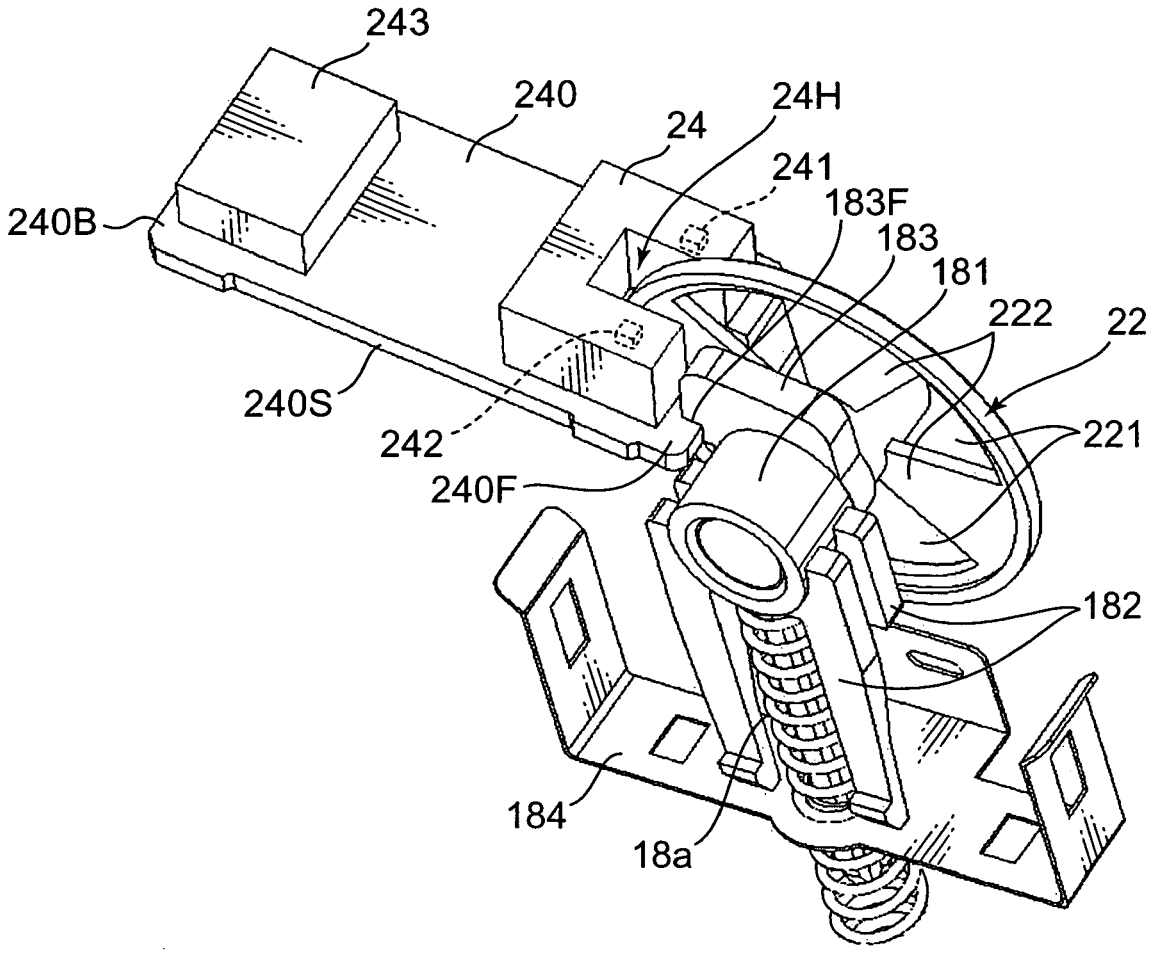
FIG. 6 is a perspective view showing a component (the board mounting the second optical sensor and a speed-detecting actuator) of the position adjustment mechanism.

The second optical sensor 24 is mounted on a board 240 together with a given electronic component 243. As shown in FIG. 5, the board 240 has a front end 240F formed with a cutout 240H for receiving therein the actuator 22, and the second optical sensor 24 is mounted on the board 240 in such a manner that the cutout 240H and a void portion 24H formed in the second optical sensor 24 (space having a portion of the light-blocking member inserted thereinto) are aligned with one another. Based on this arrangement, light can be emitted and received between the light-emitting element 241 and the light-receiving element 242 of the second optical sensor 24 while interposing the actuator 22 therebetween.

This board 240 is integrally attached to the bearing member 181. Specifically, the front end 240F of the board 240 is fixedly attached to an anchor portion 183F of an anchorage member 183 integrated with the bearing member 181 (a member integral with a bearing) (only the anchorage member 183 is illustrated in FIG. 5). Thus, if the bearing member 181 is changed in position, the board 240 will be simultaneously changed in position through the anchorage member 183.

Figure 7:
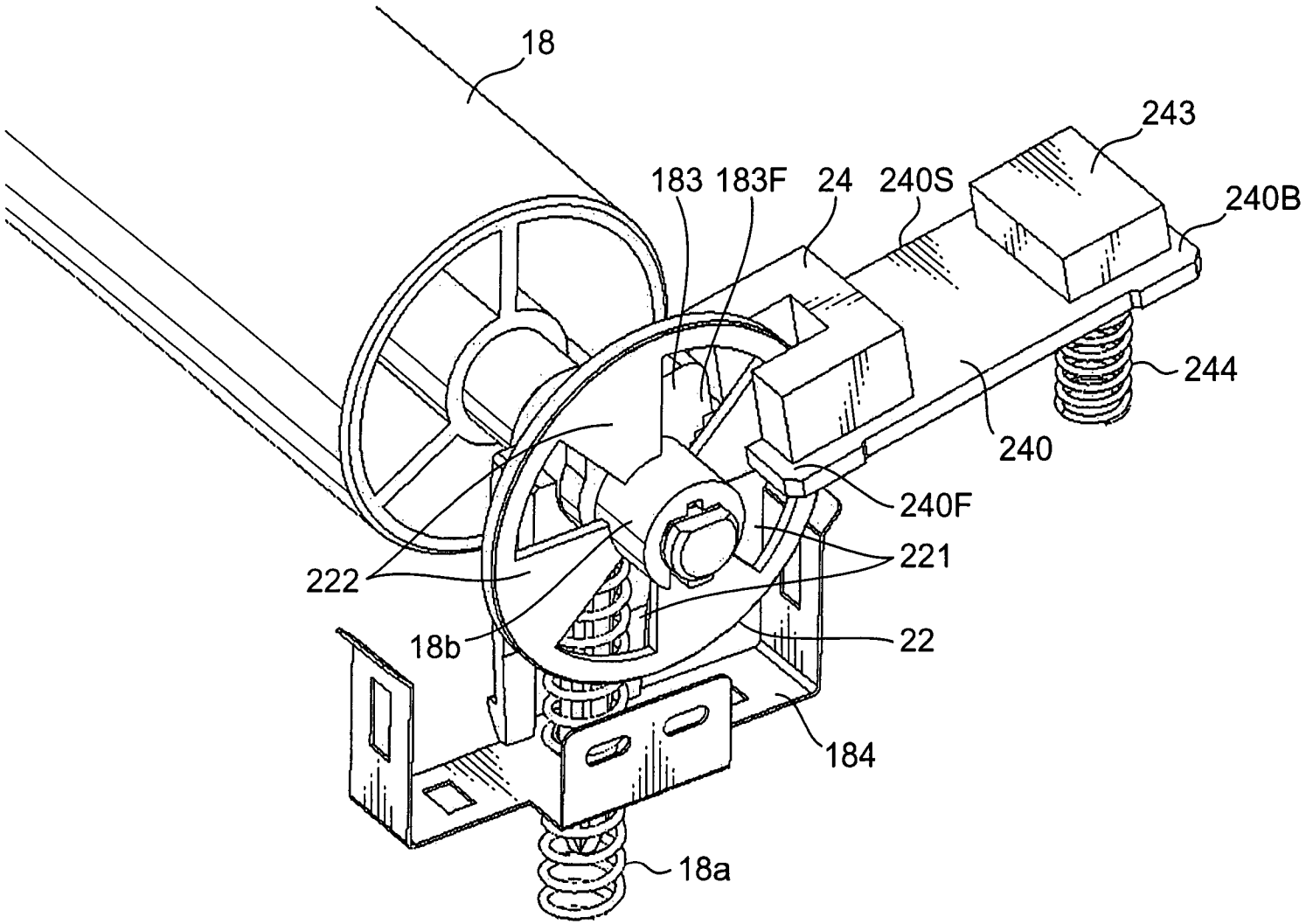
FIG. 7 is a perspective view showing a component (the board mounting the second optical sensor and the speed-detecting actuator) of the position adjustment mechanism.

The board 240 has a rear end 240B held by a hook member 232 integral with the printer housing 23. As shown in FIG. 7, the rear end 240B is pressed toward an inner peripheral wall of the hook member 232 by a biasing force of a bias spring 244. The board 240 has a sidewall 240S which is in contact with (guided by) a protrusion 233 integral with the printer housing 23, so that the board 240 is restricted in lateral wobbling.

The board 240 mounting the second optical sensor 24 is attached in the above manner. Thus, when the tension roller 18 (bearing member 181) is moved vertically between the upright ribs 231, the vertical movement is transmitted to the front end 240F of the board 240 through the anchorage member 183. Then, in a state when the sidewall 240S of the board 240 is being guided by the protrusion 233, the board 240 is followingly moved vertically on the basis of a movable support defined by the rear end 240B held by the hook member 232. While the actuator 22 attached to the rotating shaft 18*b* is changed in position by the vertical movement of the tension roller 18, the second optical sensor 24 mounted on the front end 240F of the board 240 is simultaneously changed in position to prevent occurrence of a relative displacement in a positional relationship between the actuator 22 and the second optical sensor 24. This makes it possible to accurately detect a rotation speed of the tension roller 18.

Figure 8:
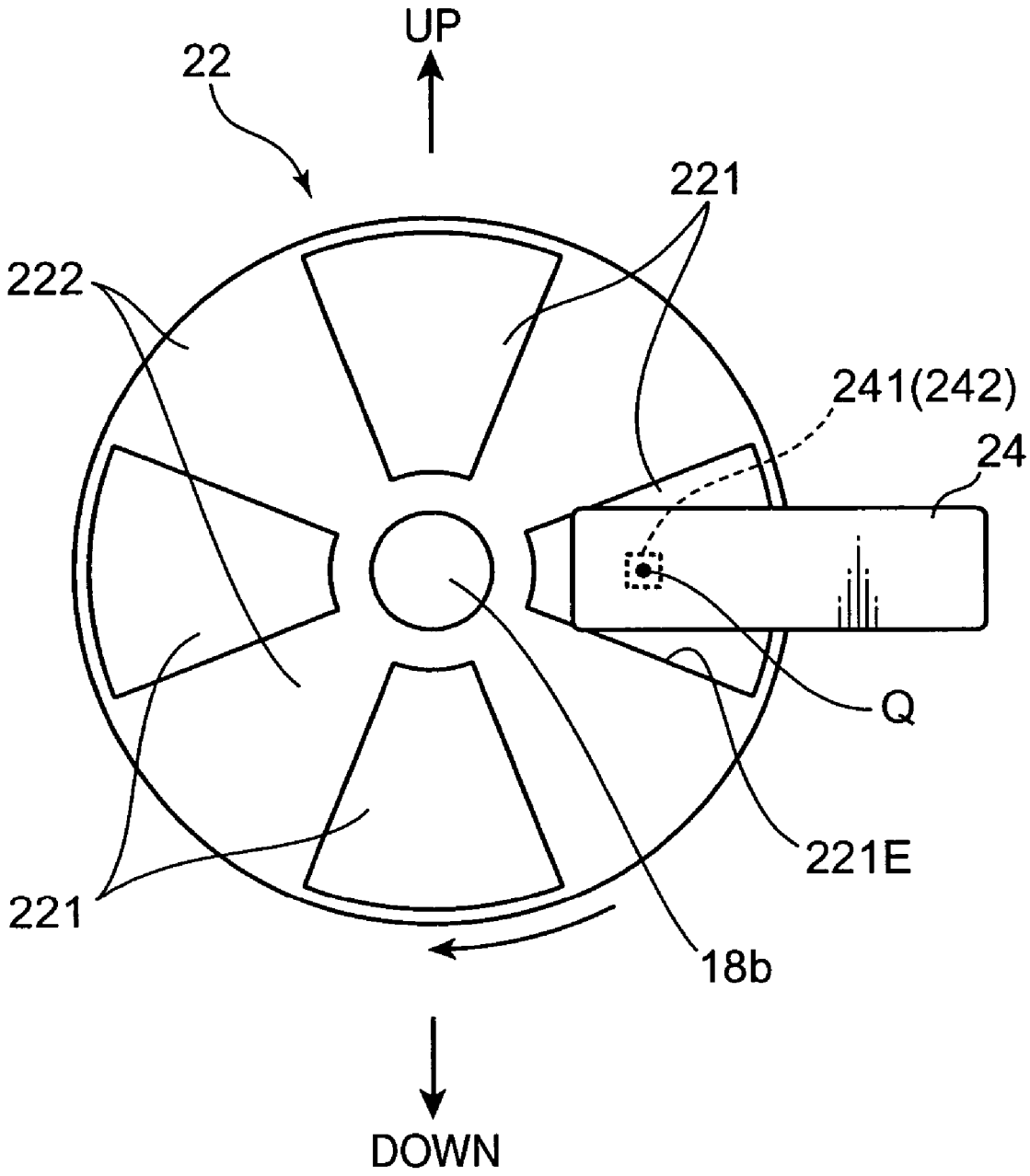
FIG. 8 is a side view showing a positional relationship between the actuator and the second optical sensor.
Figure 9:
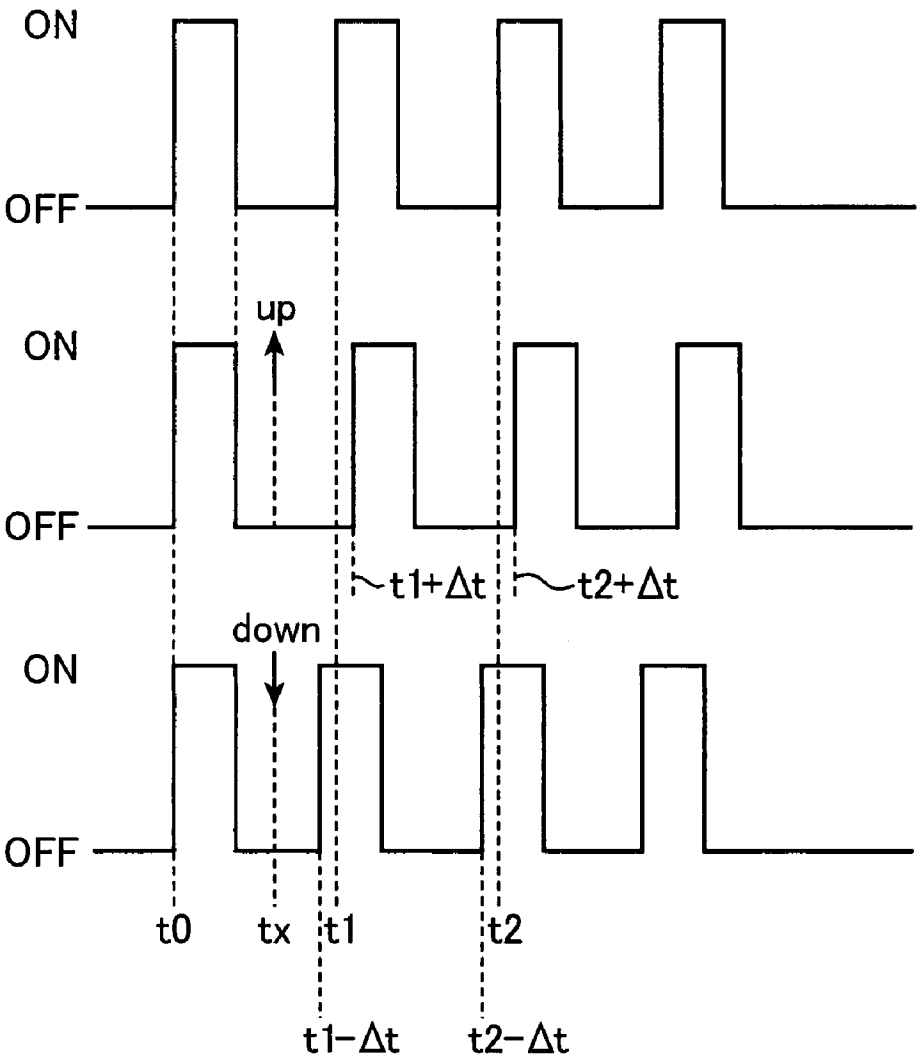
FIG. 9 is a time chart showing a light-receiving signal of a light-receiving element.

With reference to FIGS. 8 and 9, this point will be described in detail. FIG. 8 is a side view showing a positional relationship between the actuator 22 and the second optical sensor 24, and FIG. 9 is a time chart showing a light-receiving signal of the light-receiving element 242. As described above, the actuator 22 is composed of the circular disc-shaped member having the sector-shaped openings 221 and the light-blocking portions 222 which are alternately arranged in a circumferential direction, and the second optical sensor 24 has the light-emitting element 241 and the light-receiving element 242 which are arranged in opposed relation to one another while interposing the actuator 22 therebetween. The code Q indicates a light-emitting/light-receiving point of the light-emitting element 241 and the light-receiving element 242.

Given that the tension roller 18 is located at a given position, and the actuator 22 is rotated about the rotating shaft 18*b* under the condition that the light-emitting element is activated to emit light, a light-receiving signal is detected through the light-receiving element 242 when the opening 221 is passing through the light-emitting/light-receiving point Q, and no light-receiving signal is detected through the light-receiving element 242 when the light-blocking portion 222 is passing through the point Q because the light is blocked by the light-blocking portion 222. Thus, a pulse signal as shown in FIG. 9A is detected through the light-receiving element 242. An interval of the adjacent pulses. (time interval between time t1 and time t2) can be measured to detect a rotation speed of the actuator 22 or a rotation speed of the tension roller 18.

When the actuator 22 (tension roller 18) is moved upward, and displaced upward relative to the light-emitting/light-receiving point Q, the timing when a rotationally-leading edge 221E of the opening 221 reaches the light-emitting/light-receiving point Q will be delayed in proportion to the upward movement. Thus, a light-receiving signal has a phase lag. Specifically, as shown in FIG. 9B, when the actuator 22 is moved upward at time tx, a light-receiving signal is detected with a delay time Δt corresponding to the delay in reaching of the rotationally-leading edge 221E, as compared with a light-receiving start time t1 in the state when the actuator 22 is located at the given position. In the same manner, as compared with a subsequent light-receiving start time t2, a light-receiving signal is detected with a delay time Δt.

Reversely, when the actuator 22 is moved downward, and displaced downward relative to the light-emitting/light-receiving point Q, the timing when the rotationally-leading edge 221E of the opening 221 reaches the light-emitting/light-receiving point Q will be advanced in proportion to the downward movement. Thus, a light-receiving signal has a phase lead. Specifically, as shown in FIG. 9C, when the actuator 22 is moved downward at time tx, a light-receiving signal is detected with an advance time Δt corresponding to the advance in reaching of the rotationally-leading edge 221E, as compared with a light-receiving start time t1 in the state when the actuator 22 is located at the given position, which. In the same manner, as compared with a subsequent light-receiving start time t2, a light-receiving signal is detected with an advance time Δt.

If a phase shifting in the light-receiving signal occurs due to a relative displacement between the actuator 22 and the second optical sensor 24, a pulse interval cannot be accurately detected to cause difficulty in knowing a linear speed of the intermediate transfer belt 15 with a high degree of accuracy. This makes it difficult to perform color-misregistration correction with a high degree of accuracy. As measures against this problem, the position adjustment mechanism illustrated in FIG. 4 to 7 allows the second optical sensor 24 to be followingly moved in response to a change in position of the actuator 22 so as to prevent occurrence of the above phase shifting in the light-receiving signal.

Figure 10:
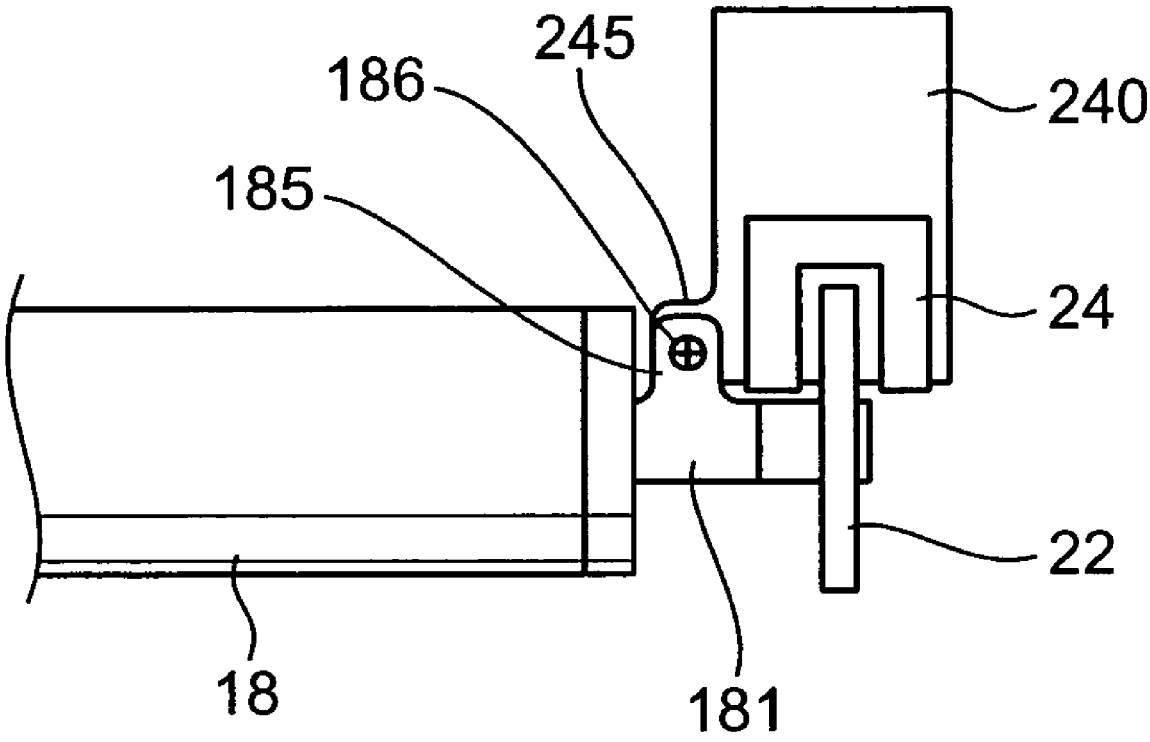
FIG. 10 is a top view showing one example of a simplified position adjustment mechanism.

The position adjustment mechanism may have any other suitable structure capable of allowing the second optical sensor 24 to be followingly moved in response to a change in position of the actuator 22. FIG. 10 is a top view showing one example of a simplified position adjustment mechanism. In this example, the bearing member 181 is integrally formed with a flange 185, and the board 240 mounting the second optical sensor 24 is formed with a flange 245. These flanges 185, 245 are joined to one another and fastened together using a screw 186. This structure can also prevent a relative displacement between the actuator 22 and the second optical sensor 24.

Figure 11:
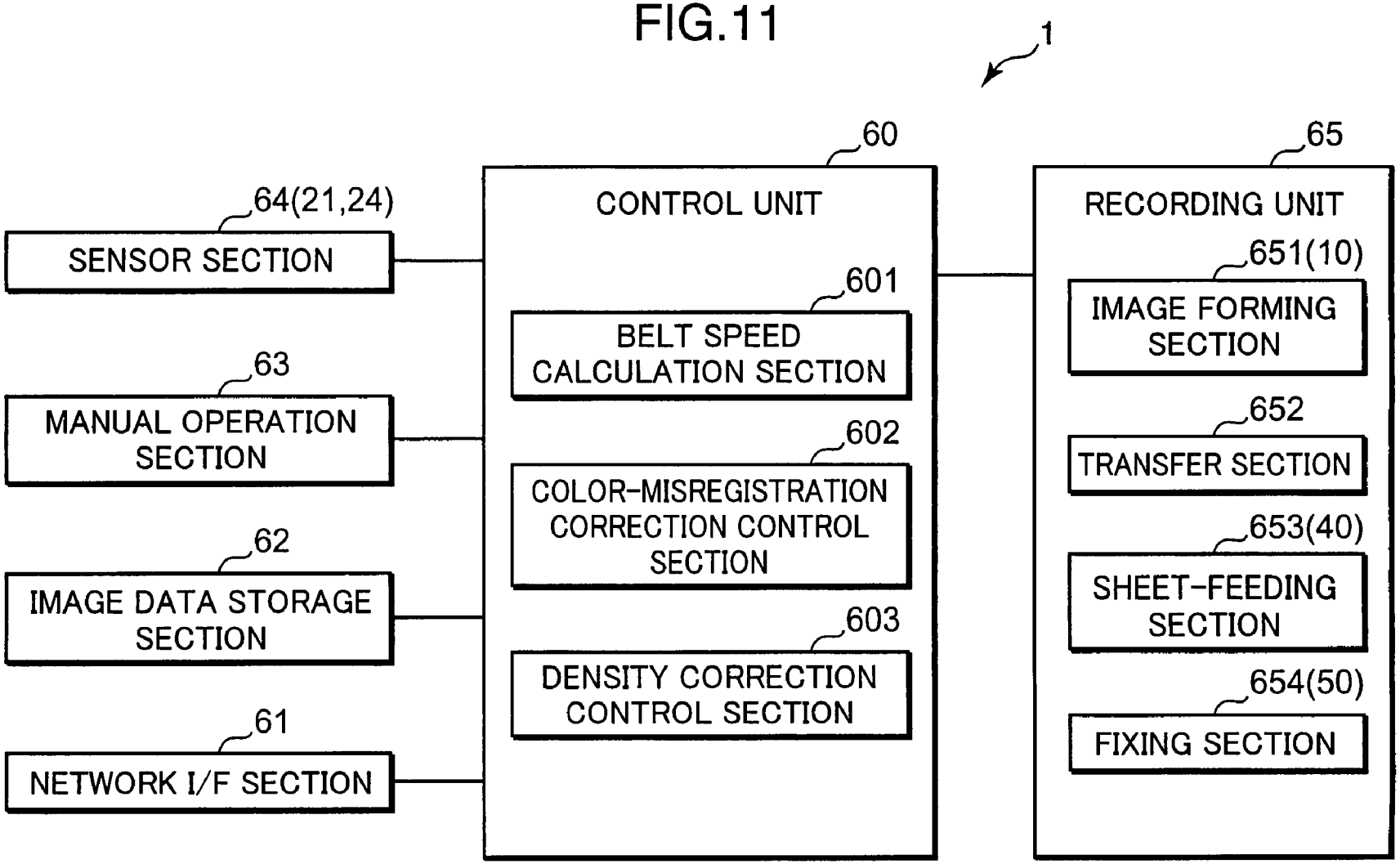
FIG. 11 is a schematic block diagram showing an electric configuration of the printer.

An electrical configuration of the printer 1 according to this embodiment will be described below. FIG. 11 is a schematic block diagram showing the electric configuration of the printer 1. This printer 1 is equipped with a network I/F (interface) section 61, an image data storage section 62, a manual operation section 63, a sensor section 64 (corresponding to the first optical sensor 21 and the second optical sensor 24), a recording unit 65 and a control unit 60.

The network I/F section 61 is provides as a means to control various data communication with an information processing apparatus, such as a personal computer (PC), connected thereto via a network, such as LAN. The image data storage section 62 is provided as a means to temporarily store image data transmitted from a PC or the like through the network I/F section 61. The manual operation section 63 is disposed at a front portion of the printer 1 to serve as a input key for allowing a user to enter various operational instructions (commands) therethrough or as a means to display given information. The sensor section 64 is provided as a means to detect information about the registration-detector pattern, the image-density-detector pattern and a linear speed of the intermediate transfer belt 15.

The recording unit 65 is provided as a means to print on a sheet based on image data stored on the image data storage section 62. The recording unit 65 includes an image forming section 651, a transfer section 652, a sheet-feeding section 653 and a fixing section 654. The image forming section 651 corresponds to the image forming section illustrated in FIGS. 1 and 2, and serves as a means to form four toner images of different colors, respectively, on the photosensitive drums 11*a* to 14*a*. The transfer section 652 comprises the intermediate transfer belt 15, the drive roller 16, the driven roller 17, the tension roller 18, the primary transfer rollers 19*a* to 19*d* and the secondary transfer roller 20, and serves as a means to transfer respective toner images (color images or monochrome images) on the photosensitive drums 11*a* to 14*a*, onto a sheet through the intermediate transfer belt 15, as described in connection with FIGS. 1 and 2. The sheet-feeding section 653 and the fixing section 654 correspond to the aforementioned sheet-feeding section 40 and fixing section 50, respectively.

The control unit 60 comprises a ROM (Read Only Memory) for storing various control programs, a RAM (Random Access Memory) for temporarily storing data and providing a working space, and a microcomputer operable to read and execute each of the control programs, and serves as a means to transmit various control signals to each of the functional sections so as to control operations of the entire printer 1. The control unit 100 includes a belt speed calculation section 601, a color-misregistration correction control section 602 and a density correction control section 603.

The belt speed calculation section 601 is operable to acquire a light-receiving signal (a pulse signal as shown in FIG. 9; roller rotation speed signal) of the second optical sensor to measure a time interval between light-receiving and light-blocking in the signal (pulse interval), and calculate a rotation speed of the tension roller 18 or a linear speed of the intermediate transfer belt 15, based on the measured time interval.

The color-misregistration correction control section 602 is operable to calculate an amount of color misregistration, based on a registration detection signal which is a registration-detector pattern scan signal output from the first optical sensor 21. Then, the color-misregistration correction control section 602 is operable to calculate a color-misregistration correction value with reference to information about the linear speed of the intermediate transfer belt 15 calculated by the belt speed calculation section 601. Specifically, a write-start position for each toner image of the four colors is changed depending on a linear speed of the intermediate transfer belt 15. Thus, the color-misregistration amount obtained from the registration detection signal is adjusted based on a difference between a predetermined target rotation speed and the linear speed of the intermediate transfer belt 15 calculated by the belt speed calculation section 601, to determine the color-misregistration correction value (adjustment value of a write-start timing for each toner image of the four colors.

The density correction control section 603 is operable to calculate a density correction value, based on a density-detection-voltage value which is a density-detector-pattern scan signal output from the first optical sensor 21, and a background voltage value which is an output of the first optical sensor 21 in a state when no density-detector pattern is printed. Specifically, a difference between the background voltage value and the density-detection voltage value is calculated, and then this difference is compared with a target voltage corresponding to a predetermined desired density to determine the density correction value.

Figure 12:
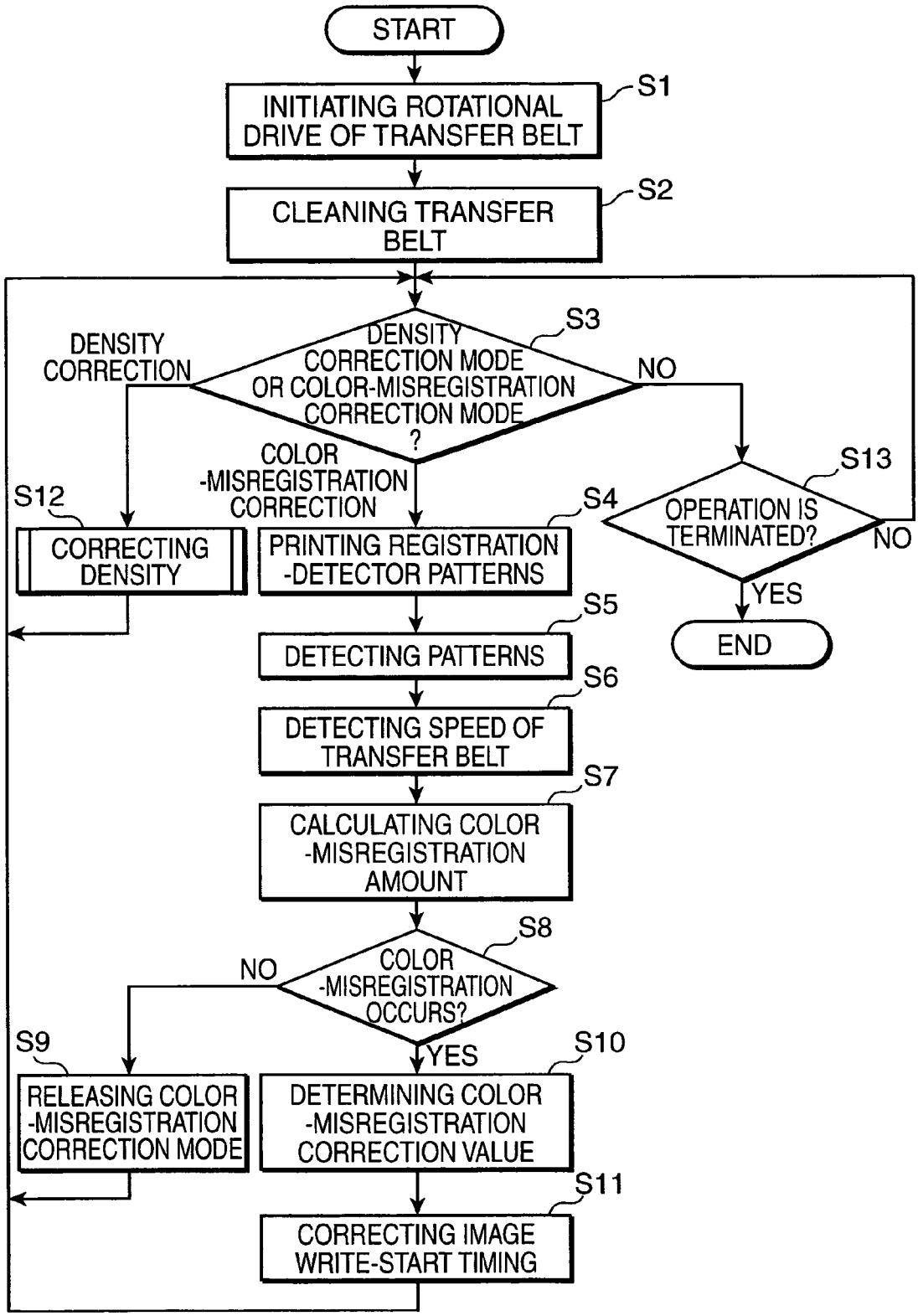
FIG. 12 is a flowchart primarily showing a process of color-misregistration correction control.

An operation (color-misregistration correction control process and image-density correction control process) of the printer 1 according to this embodiment will be described below. FIG. 12 is a flowchart primarily showing the process of color-misregistration correction control. Upon turning on a power switch of the printer 1, the stepping motor (not shown) connected to a rotating shaft of the drive roller 16 is activated to rotationally drive the intermediate transfer belt 15 (Step S1). During this process, the intermediate transfer belt 15 is cleaned by the far brush 15*a* (Step S2).

Then, the control unit 60 checks an operation mode, or checks whether either one of a density correction mode and a color-misregistration correction mode is set up (Step 53). If the color-misregistration correction mode is set up, each of the image-forming units 11 to 14 prints a given registration-detector pattern for each of the four colors on the intermediate transfer belt 15 (Step S4). Then, the first optical sensor 21 (registration sensor) detects these registration-detector patterns, and outputs a registration detection signal representing color misregistration to the color-misregistration correction control section 602 of the control unit 60 (Step S5). Concurrently, the second optical sensor 24 measures a rotation speed of the tension roller 18, and the belt speed calculation section 601 calculates a linear speed of the intermediate transfer belt 15, based on a roller rotation speed signal output from the second optical sensor 24 (Step S6).

Then, the color-misregistration correction control section 602 calculates a color-misregistration amount based on the registration detection signal (Step S7). Then, based on the calculated color-misregistration amount, the color-misregistration correction control section 602 determines whether a color misregistration requiring a correction occurs (Step S8). If it is determined that no color misregistration occurs (NO in Step S8), the color-misregistration correction mode is released to terminate the color-misregistration correction control, and the process returns to Step S3.

When it is determined that a color misregistration occurs (YES in Step S8), the color-misregistration correction control section 602 acquires information about a linear speed of the intermediate transfer belt 15 from the belt speed calculation section 601 to calculate a deference from the predetermined target rotation speed, and adjusts the obtained color-misregistration amount based on this difference to determine a color-misregistration correction value (Step S10). Then, the color-misregistration correction control section 602 corrects an image write-start timing based on the determined color-misregistration correction value (Step S11). For example, a laser radiation timing in each of the light-exposing devices 32 is corrected. Then, the process returns to Step S3, and the above steps will be repeated until the color misregistration is cleared.

In this embodiment, during the above color-misregistration correction control, a linear speed of the intermediate transfer belt 15 is obtained based on a rotation speed of the tension roller 18. Thus, the linear speed of the intermediate transfer belt 15 can be accurately obtained, and therefore the color-misregistration correction can be accurately performed. In particular, the position adjustment mechanism illustrated in FIGS. 4 to 7 makes it possible to detect a linear speed of the intermediate transfer belt 15 with a high degree of accuracy even if the tension roller 18 is changed in position, and perform on-target color-misregistration correction.

Further, in this embodiment, the tension roller 18 is disposed between the secondary transfer position (secondary transfer roller 20) and the image-forming unit 14 located on the rotationally downstreammost side of the intermediate transfer belt 15. Thus, a linear speed of the intermediate transfer belt 15 just after the color superimposition process can be measured to provide enhanced accuracy in the color-misregistration correction control. In addition, a linear speed of the intermediate transfer belt 15 is obtained based on a rotation speed of the tension roller 18, and the registration sensor (first optical sensor 21) is disposed in opposed relation to the tension roller 18. This makes it possible to adequately correlate between a color-misregistration amount to be detected by the registration sensor and a linear speed of the intermediate transfer belt 15 so as to provide enhanced accuracy in the color-misregistration correction control.

Figure 13:
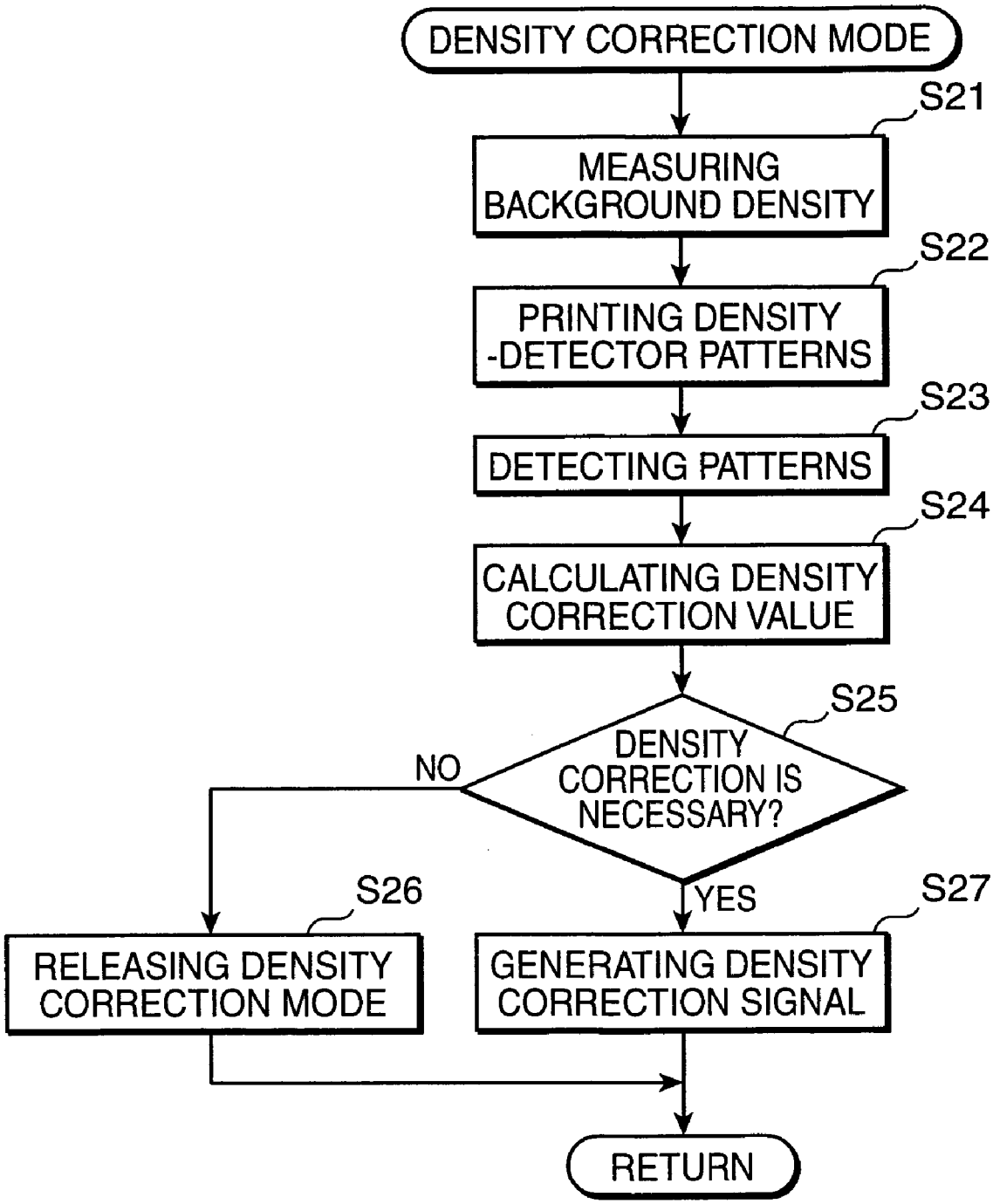
FIG. 13 is a flowchart showing a process of density correction control.

When it is determined in Step S3 that the density correction mode is set up, a density correction control as shown in FIG. 13 is performed. If it is determined in Step S3 that none of the color-misregistration correction mode and the density correction mode is set up (NO in Step S3), it is determined whether an operation termination command is issued (Step S13). If it is determined that the operation termination command is issued (YES in Step S13), the process is completed. When it is determined that no operation termination command is issued (NO in Step S13), the process returns to Step S3, and the above steps will be repeated.

FIG. 13 is a flowchart showing the process of density correction control. In this process, the first optical sensor 21 (density sensor) firstly measures a surface condition of the intermediate transfer belt 15 in a state before a toner image is formed thereon. That is, the first optical sensor 21 measures a density of the intermediate transfer belt 15 in a state before a toner image is formed thereon, and outputs a background voltage value to the density correction control section 603 of the control unit 60 (Step S21).

Then, each of the image-forming units 11 to 14 prints a given density-detector pattern for each of the four colors on the intermediate transfer belt 15 (Step S22). Then, the first optical sensor 21 detects these density-detector patterns, and outputs a density detection voltage value to the density correction control section 603 (Step S23).

The density correction control section 603 calculates a difference between the background voltage value and the density detection voltage value, and compares this difference with the target voltage value corresponding to the predetermined density to determine a density correction value. That is, the control unit calculates a density correction value, based on the background voltage value, the density detection voltage value and the target voltage value (Step S24). Then, the density correction control section 603 determines whether the determined density correction value falls within a predetermined threshold range (Step S25). If the determined density correction value falls within the threshold range, it is determined that the density correction is unnecessary (NO in Step S25), and the density correction mode is released (Step S26). When it is determined that the determined density correction value deviates from the threshold range (YES in Step S25), the density correction control section 603 generates a density correction signal, for example, for correcting a development bias value or a laser output value in each of the light-exposing devices 32 (Step S27). Then, the process returns to Step S3, and the above steps will be repeated.

While a specific embodiment of the present invention has been shown and described, the present invention is not limited to the above embodiment. For example, the following modifications may be made therein.

While the image forming apparatus in the above embodiment is designed to primarily transfer a color toner image onto the surface of the intermediate transfer belt 15 and then transfer the color toner image onto a sheet P by use of the secondary transfer roller 20, a sheet P may be placed on the surface of the intermediate transfer belt 15 and then toner images may be sequentially transferred from the image-forming units 11 to 14 onto the sheet P in a superimposed manner.

While the image forming apparatus in the above embodiment is designed to transfer toner images in order of M, C, Y and K and register the color, the image forming apparatus of the present invention is not limited to this manner, but may be designed to transfer toner images of M, C, Y and K in any other suitable order and register the color.

While the image forming apparatus in the above embodiment comprises two driven rollers (driven roller 17 and tension roller 18), the image forming apparatus of the present invention is not limited to this structure, but may have three driven rollers or more. Further, as to the number of main rollers, the image forming apparatus of the present invention is not limited to one as in the above embodiment (drive roller 16), but it may be two or more. When the tension rollers 18 are provided in a number of two or more, the image forming apparatus may be designed to detect a rotation speed of at least one of the tension rollers 18.

While the image forming apparatus in the above embodiment is designed to lay the intermediate transfer belt 15 across three rollers consisting of the drive roller 16, the driven roller 17 and the tension roller 18, in a tensioned condition, the driven roller 17 may be omitted to lay the intermediate transfer belt 15 across only two rollers consisting of the drive roller 16 and the tension roller 18, in a tensioned condition.

In the above embodiment, the image forming apparatus of the present invention has been described by taking the printer 1 as one example. It is understood that the present invention may be applied to a copy machine, a facsimile machine or a complex machine thereof.

This application is based on patent application Nos. 2005-022940 and 2005-335609 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a transfer belt adapted to allow a plurality of toner images of different colors to be sequentially superimposed and transferred onto a surface thereof so as to form a color toner image;

a plurality of image-forming units disposed along said transfer belt and each adapted to form a toner image with a corresponding one of said colors and transfer said toner image onto said transfer belt;

a transfer device for transferring the color toner image on said transfer belt to a recording sheet at a secondary transfer position;

a drive roller for rotationally driving said transfer belt;

a tension roller disposed between said secondary transfer position and one of said image forming units located on a downstreammost side of said transfer belt in a rotation direction thereof, said tension roller allowing said transfer belt to be laid thereacross in a tensioned condition in cooperation with said drive roller, said tension roller being adapted to be changed in position in response to a biasing force to apply a tension to said transfer belt; and a speed detector for detecting a rotation speed of said tension roller and outputting a roller rotation speed signal.

2. The image forming apparatus as defined in claim 1, which includes a controller for performing a color-misregistration correction control of adjusting a write-start timing for each toner image of said colors in each of said plurality of image-forming units, said controller being operable to obtain a linear speed of said transfer belt based on said roller rotation speed signal representing the rotation speed of said tension roller, and determine a color-misregistration correction value representing a correction value of said write-start timing, based on said obtained linear speed.

3. The image forming apparatus as defined in claim 2, which includes a registration sensor for detecting a registration-detector pattern formed on said transfer belt for each of said colors, in advance of said color-misregistration correction control, said registration sensor being disposed in opposed relation to said tension roller while interposing said transfer belt therebetween.

4. An image forming apparatus comprising:

a transfer belt adapted to allow a plurality of toner images of different colors to be sequentially superimposed and transferred onto a surface thereof or a recording sheet placed on said surface so as to form a color toner image;

a plurality of image-forming units disposed along said transfer belt and each adapted to form a toner image with a corresponding one of said colors and transfer said toner image onto said transfer belt or recording sheet;

a transfer device for transferring the color toner image on said transfer belt to a recording sheet at a secondary transfer position;

a drive roller for rotationally driving said transfer belt;

a tension roller allowing said transfer belt to be laid thereacross in a tensioned condition in cooperation with said drive roller, said tension roller being adapted to be changed in position in response to a biasing force to apply a tension to said transfer belt;

a biasing device for applying the biasing force to the tension roller;

a speed detector for detecting a rotation speed of said tension roller and outputting a roller rotation speed signal; and a position adjustment mechanism for moving a position of the speed detector for preventing relative displacement between said speed detector and said tension roller.

5. The image forming apparatus as defined in claim 4, wherein said speed detector includes:

a light-blocking member attached to a rotating shaft of said tension roller in such a manner as to be rotated in synchronization with said tension roller; and a photosensor mounted on a given board and provided with a light-emitting element and a light-receiving element which are disposed in opposed relation to one another with a space allowing said light-blocking member to interpose therebetween, a part of said board being secured to a bearing of the rotating shaft of said tension roller or a member integral with said bearing.

6. The image forming apparatus as defined in claim 5, wherein said photosensor is mounted on one of opposite ends of said board, said one end of said board being secured to the bearing of the rotating shaft of said tension roller or the member integral with said bearing, the other end of said board being supported by a movable support allowing said board to be moved in conformity to a positional change of said tension roller.

* * * * *